US011019882B2

(12) United States Patent
Chen

(10) Patent No.: US 11,019,882 B2
(45) Date of Patent: Jun. 1, 2021

(54) FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 232 days.

(21) Appl. No.: 16/308,816

(22) PCT Filed: Nov. 10, 2017

(86) PCT No.: PCT/CN2017/110362
§ 371 (c)(1),
(2) Date: Dec. 10, 2018

(87) PCT Pub. No.: WO2018/086570
PCT Pub. Date: May 17, 2018

(65) Prior Publication Data

US 2019/0144150 A1 May 16, 2019

(30) Foreign Application Priority Data

Nov. 11, 2016 (CN) ..... 201621261485.0

(51) Int. Cl.
*A43C 11/16* (2006.01)
*A43C 1/00* (2006.01)

(52) U.S. Cl.
CPC ..... *A43C 11/165* (2013.01)

(58) Field of Classification Search
CPC ..... A43C 11/165; A43C 1/003; A43C 7/00; Y10T 24/2183; Y10T 24/3724
See application file for complete search history.

(56) References Cited

U.S. PATENT DOCUMENTS 8,832,912 B2 * 9/2014 Ha ..... A43C 11/165 24/712.9
10,772,385 B2 * 9/2020 Jiang ..... A43C 11/165
2012/0228419 A1 9/2012 Chen
2013/0092780 A1 * 4/2013 Soderberg ..... A43C 11/165 242/396.4
2014/0359981 A1 * 12/2014 Cotterman ..... A43C 11/165 24/712.9
2015/0191326 A1 * 7/2015 Hall ..... A42B 3/08 242/396.4
2017/0325548 A1 * 11/2017 Ha ..... A43C 7/00
(Continued)

FOREIGN PATENT DOCUMENTS

CN 203492894 U 3/2014
CN 204895922 U 12/2015
(Continued)

*Primary Examiner* — Robert Sandy
*Assistant Examiner* — Rowland Do
(74) *Attorney, Agent, or Firm* — CRC & Partners Co., LLC

(57) ABSTRACT

A fastening device includes a case, a spool, a locking unit and a knob. The case includes a receiving space and a plurality of side teeth. The spool is disposed within the case, and the lace is wound therearound. The locking unit includes a ring body and at least one pawl arm. The ring body is optionally coupled to the spool and includes a blocking portion. The at least one pawl arm includes a first terminal and a second terminal. The second terminal is engaged with the side teeth in a loosening direction and is disengaged from the side teeth in a tightening direction. The second terminal includes an abutting portion abutted against the blocking portion in the loosening direction.

10 Claims, 11 Drawing Sheets

(56) References Cited

U.S. PATENT DOCUMENTS

| | | | | |
|---|---|---|---|---|
| 2018/0132567 | A1* | 5/2018 | Lee | A43C 11/20 |
| 2019/0000187 | A1* | 1/2019 | Chen | A43C 11/008 |
| 2020/0128919 | A1* | 4/2020 | Burt | E05C 3/122 |

FOREIGN PATENT DOCUMENTS

| | | | |
|---|---|---|---|
| CN | 106545552 | A | 3/2017 |
| CN | 206187398 | U | 5/2017 |
| CN | 106915488 | A | 7/2017 |
| CN | 106919220 | A | 7/2017 |
| JP | H09110021 | A | 4/1997 |
| JP | 3165581 | U | 1/2011 |
| JP | 2016520401 | A | 7/2016 |
| WO | 2015089539 | A1 | 6/2015 |

* cited by examiner

FASTENING DEVICE

RELATED APPLICATIONS

This application is a continuation of International application No. PCT/CN2017/110362, filed Nov. 10, 2017, which claims the benefits of priority of CN application No. 201621261485.0 filed on Nov. 11, 2016, the content of which are incorporated herein by reference.

BACKGROUND

Technical Field

The present disclosure relates to a fastening device. More particularly, the present disclosure relates to a fastening device for securing an article through loosening or tightening a lace.

Description of Relative Art

In daily life, cords, such as a lace or a thread, are usually used to tighten articles. The most common tightening method is to use the cord to reciprocately pass through holes on the article, e.g., eyelets of a shoe, and then tie a knot to secure the article. But in this kind of tightening method, the knot is loosened easily due to an external force. Not only does the knot need to be tied again, but also lots of inconveniences come owing to the insecurity of the articles.

In order to solve such problems, some practitioners developed a simple fastening mechanism including a case, an engaging unit and a spring. The case includes holes to allow the lace to pass therethrough. Through the reaction force between the spring and the engaging unit, the lace can be clamped between the engaging unit and the case so as to be fastened. The length of the lace can be changed by pressing the spring to change the position of the engaging unit. However, in such fastening mechanism, the restoring force of the spring is served as the securing force; thus, the lace is easily to be released owing to vibrations or an external force. In addition, the fastening mechanism has no space for receiving the lace, and the exposure of the lace may bring danger.

Therefore, some practitioners developed another kind of buckle which can be rotated to tighten the lace, and the lace can be received inside the buckle. Through the interference between components inside the buckle, the length of the lace as well as the tightness can be adjusted. However, the structure of the buckle is complex; as a result, the manufacturing cost is increased, and the buckle has assembly and repair difficulty.

Base on the above-mentioned problems, how to simplify the structure of the fastening device, reduce the manufacturing cost and maintain the securing capability becomes a pursuit target for practitioners.

SUMMARY

Disclosure of Invention

The present disclosure provides a fastening device, through the structure of the locking unit, the structure of the fastening device is simplified, and the securing capability of the fastening device is remained.

According to one embodiment of the present disclosure, a fastening device which is for fastening and loosening a lace is provided. The fastening device includes a case, a spool, a locking unit and a knob. The case includes a receiving space and a plurality of side teeth. The spool is disposed within the case, and the lace is wound therearound. The locking unit includes a ring body and at least one pawl arm. The ring body is optionally coupled to the spool and includes a blocking portion. The at least one pawl arm includes a first terminal and a second terminal. The first terminal is connected to the ring body. The second terminal is opposite to the first terminal. The second terminal is engaged with the side teeth in a loosening direction and is disengaged from the side teeth in a tightening direction opposite to the loosening direction. The second terminal includes an abutting portion abutted against the blocking portion in the loosening direction. The knob is coupled to the locking unit. Rotating the knob relative to the case allows the locking unit to be driven to switch from a first position to a second position. The locking unit is coupled to the spool to prohibit the spool from rotating toward the loosening direction when the locking unit is at the first position, and the spool is allowed to be rotated toward the loosening direction when the locking unit is at the second position.

Therefore, through the abutting relation between the pawl arm and the blocking portion, broken of the pawl arm caused by pressure can be prevented, the lifetime can be increased and the securing capability of the fastening device is remained while the structure can be simplified.

According to the abovementioned fastening device, the ring body can have a radial direction, and the blocking portion can be protruded outwardly from the ring body along the radial direction. The fastening device can further include a first retaining portion and a second retaining portion disposed at the ring body and coupled to the knob, and each of the first retaining portion and the second retaining portion has restoring capability in the radial direction. The knob can include two protrusions coupled to the first retaining portion and the second retaining portion, respectively. When the locking unit is driven by the knob to switch from the first position to the second position, the two protrusions push the first retaining portion and the second retaining portion, respectively, to move along the radial direction. In addition, the knob can include a spiral track. The locking unit includes a guiding portion coupled to the spiral track. When the knob is rotated toward the loosening direction, the guiding portion guided by the spiral track is raised such that the locking unit is switched to the second position.

According to another embodiment of the present disclosure, a fastening device which is for fastening and loosening a lace is provided. The fastening device includes a case, a spool, a locking unit and a knob. The case includes a receiving space and a plurality of side teeth. The spool is disposed within the case, and the lace is wound therearound. The locking unit includes a blocking portion and at least one pawl arm. The at least one pawl arm is engaged with the side teeth and abutted against the blocking portion in a loosening direction, and the at least one pawl arm is disengaged from the side teeth in a tightening direction opposite to the loosening direction. The knob is coupled to the locking unit. Rotating the knob relative to the case allows the locking unit to be driven to switch from a first position to a second position. The locking unit is coupled to the spool to prohibit the spool from rotating toward the loosening direction when the locking unit is at the first position, and the spool is allowed to be rotated toward the loosening direction when the locking unit is at the second position.

According to the abovementioned fastening device, the locking unit can include a ring body. The ring body has a radial direction, and the blocking portion can be protruded outwardly from the ring body along the radial direction. The ring body, the blocking portion and the at least one pawl arm are integrally formed. The fastening device can further include a first retaining portion and a second retaining portion disposed at the ring body and coupled to the knob, and each of the first retaining portion and the second retaining portion has restoring capability in the radial direction. The knob can include two protrusions coupled to the first retaining portion and the second retaining portion, respectively. When the locking unit is driven by the knob to switch from the first position to the second position, the two protrusions push the first retaining portion and the second retaining portion, respectively, to move along the radial direction. In addition, the knob can include a spiral track. The locking unit includes a guiding portion coupled to the spiral track. When the knob is rotated toward the loosening direction, the guiding portion guided by the spiral track is raised such that the locking unit is switched to the second position.

Through the structure configuration of the locking unit, the fastening device provided by the present disclosure, comparing to the prior arts, can remain the securing capability while the structure thereof is simplified.

DETAILED DESCRIPTION

The embodiment will be described with the drawings. For clarity, some practical details will be described below. However, it should be noted that the present disclosure should not be limited by the practical details. That is, in some embodiment, the practical details are unnecessary. In addition, for simplifying the drawings, some conventional structures and elements will be simply illustrated, and repeated elements may be represented by the same labels.

Figure 1:
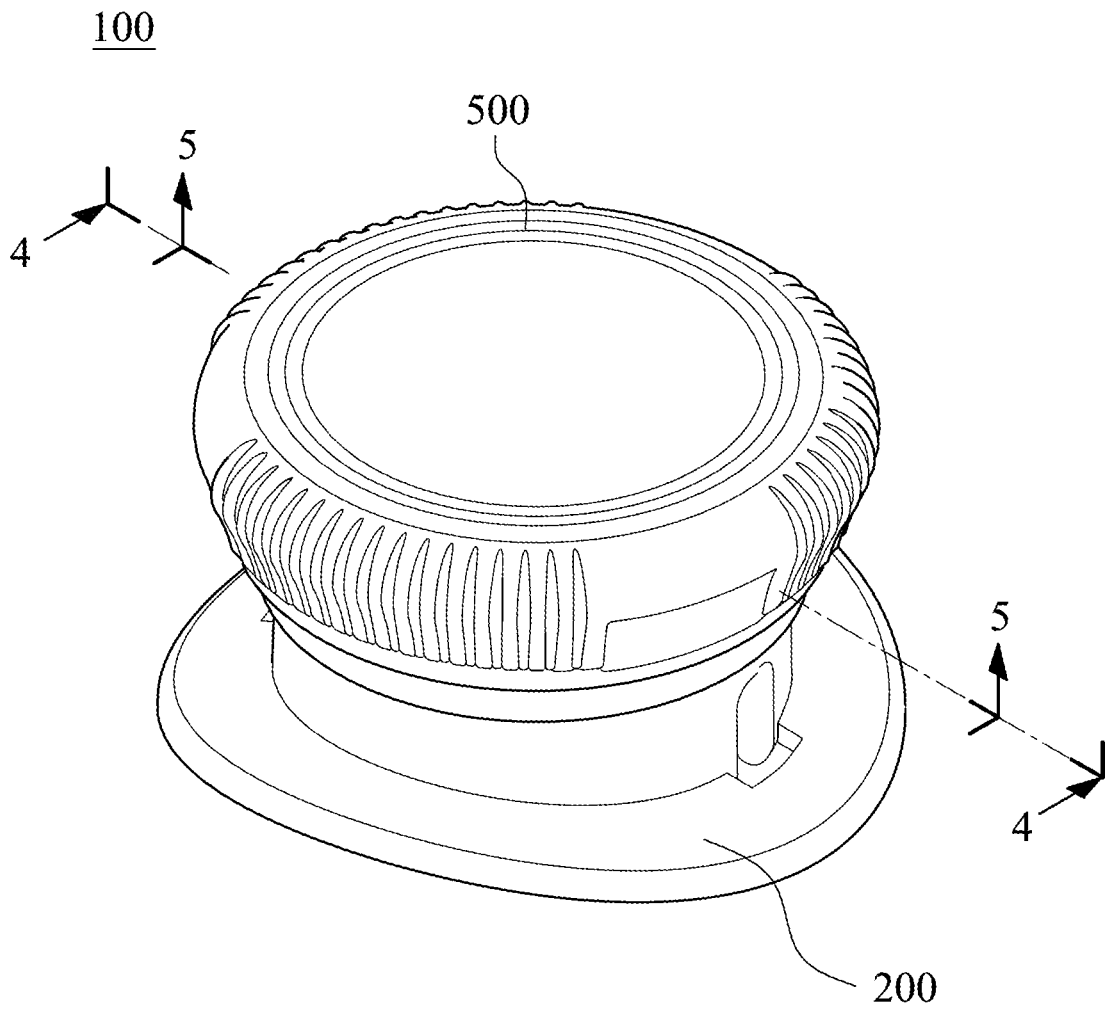
FIG. 1 shows a three dimensional schematic view of a fastening device according to one embodiment of the present disclosure.
Figure 2A:
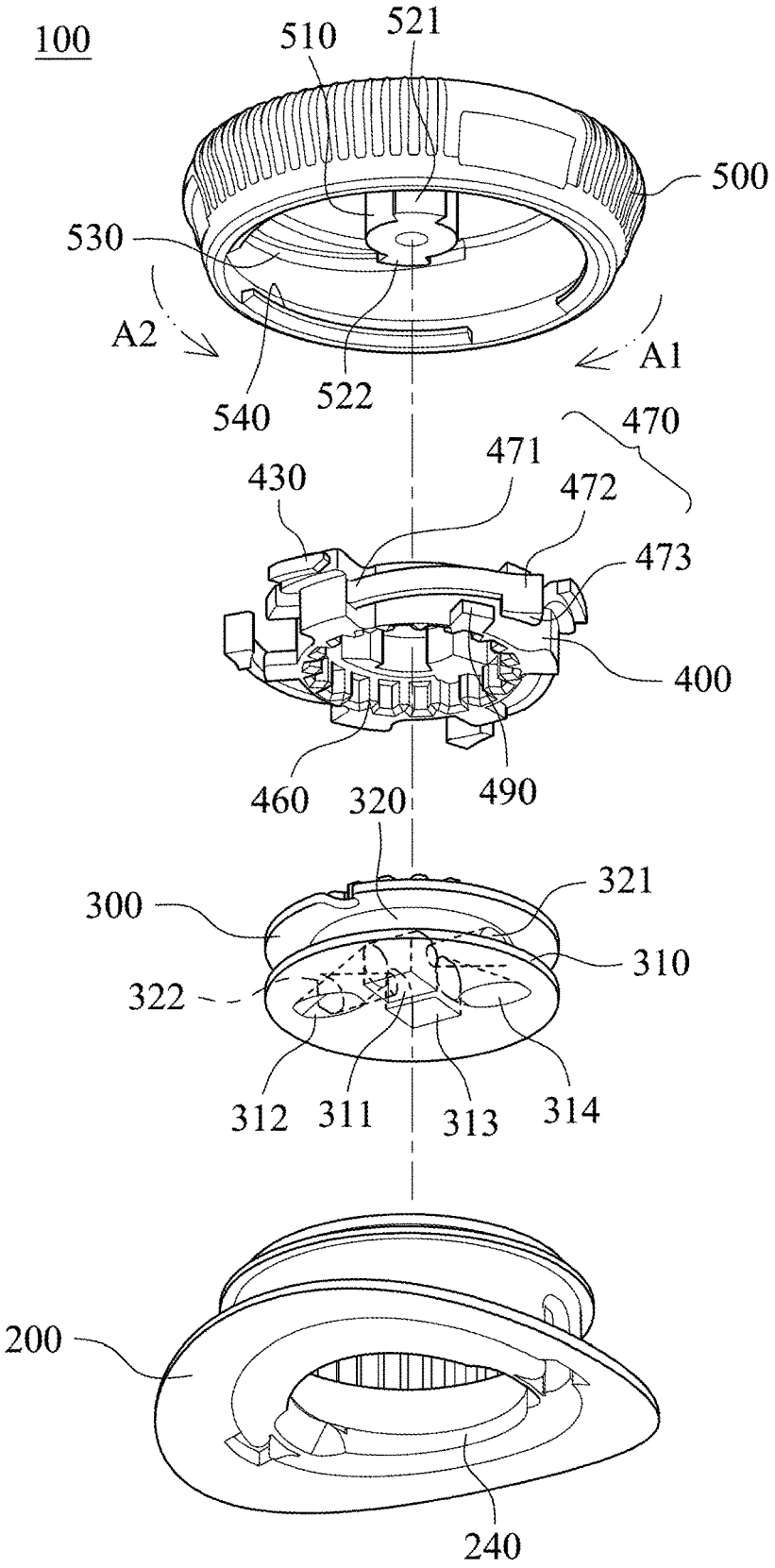
FIG. 2A shows one exploded view of the fastening device of FIG. 1.
Figure 2B:
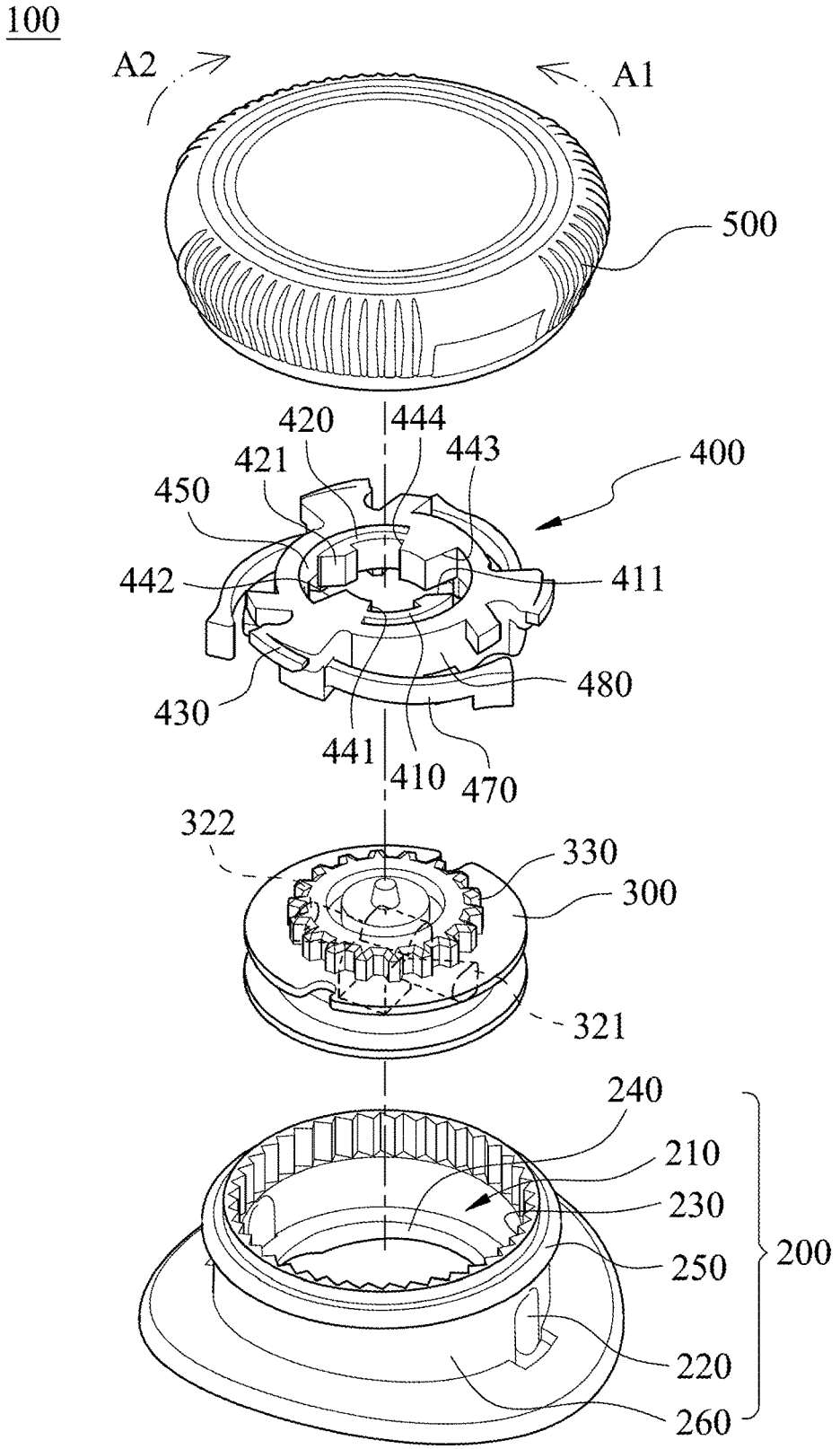
FIG. 2B shows another exploded view of the fastening device of FIG. 1.

Please refer to FIG. 1, FIG. 2A and FIG. 2B, wherein FIG. 1 shows a three dimensional schematic view of a fastening device 100 according to one embodiment of the present disclosure, FIG. 2A shows one exploded view of the fastening device 100 of FIG. 1, and FIG. 2B shows another exploded view of the fastening device 100 of FIG. 1.

The fastening device 100 which is for fastening and loosening a lace 600 includes a case 200, a spool 300, a knob 500 and a locking unit 400, the case 200 includes a receiving space 210 and a plurality of side teeth 230, the spool 300 is disposed at the case 200 and the lace 600 is wound therearound; the locking unit 400 includes a blocking portion 490 and at least one pawl arm 470, the pawl arm 470 is engaged with the side teeth 230 and abutted against the blocking portion 490 in a loosening direction A1, and the pawl arm 470 is disengaged from the side teeth 230 in a tightening direction A2 opposite to the loosening direction A1, the knob 500 is coupled to the locking unit 400; wherein rotating the knob 500 relative to the case 200 allows the locking unit 400 to be driven to switch from a first position to a second position, the locking unit 400 is coupled to the spool 300 to prohibit the spool 300 from rotating toward the loosening direction A1 when the locking unit 400 is at the first position, and the spool 300 is allowed to be rotated toward the loosening direction A1 when the locking unit 400 is at the second position.

Therefore, through the abutting relation between the pawl arm 470 and the blocking portion 490, broken of the pawl arm 470 caused by pressure can be prevented, the lifetime can be increased and the securing capability of the fastening device 100 is remained. The detail structure and operation of the fastening device 100 will be described in the following paragraphs.

The case 200 has a hollow structure, and includes a housing 260 and a mounted portion 250, the housing 260 includes the receiving space 210, the side teeth 230, two side holes 220 and a lower opening 240. The side teeth 230 face to the receiving space 210, the two side holes 220 and the lower opening 240 are communicated with the receiving space 210, and the mounted portion 250 is protruded outwardly from the housing and is ring-shaped. In the embodiment, a diameter of the lower opening 240 is smaller than a diameter of the spool 300, and after the spool 300 is disposed inside the receiving space 210 of the housing 260, it will not fall out from the lower opening 240.

The spool 300 is disc-shaped, and includes a spool cylinder 320 and a bottom 310, the spool cylinder 320 includes a first opening 321 and a second opening 322, the bottom 310 is for disposing the spool cylinder 320, the bottom 310 includes a first knotting hole 311, a first through hole 312, a second knotting hole 313 and a second through hole 314, the first knotting hole 311 and the first through hole 312 are communicated with the first opening 321, and the second knotting hole 313 and the second through hole 314 are communicated with the second opening 322. A first end and a second end of the lace 600 can pass through the first opening 321 and the second opening 322, respectively, to couple with the spool 300, such that the lace 600 can be wound around the spool cylinder 320. In addition, the spool 300 can further include a plurality of engaging teeth 330 for engaging with the locking unit 400.

The locking unit 400 includes, in addition to the pawl arm 470 and the blocking portion 490, a ring body 480, a first retaining portion 410, a second retaining portion 420, three guiding portions 430, four stopping portions 441, 442, 443, 444, a communicated hole 450 and a plurality of engaged teeth 460, in the embodiment, a number of the pawl arm 470 is three, a number of the blocking portion 490 which is corresponding to the pawl arm 470 is three, but will not be limited thereto.

The ring body 480 has a radial direction, the first retaining portion 410 and the second retaining portion 420 are disposed at the ring body 480 and are coupled to the knob 500, the guiding portions 430 having inclined block structure are protruded outwardly from the ring body 480 along the radial direction and are used for coupling to the knob 500, each of the pawl arms 470 is disposed at the ring body 480 and include a first terminal 471 and a second terminal 472, the first terminal 471 is connected to the ring body 480, the second terminal 472 is opposite to the first terminal 471, the second terminal 472 is engaged with the side teeth 230 in the loosening direction A1 and is disengaged from the side teeth 230 in the tightening direction A2. The second terminal 472 includes the abutting portion 472 abutted against the blocking portion 490 in the loosening direction A1, and the abutting portion 472 is protruded from the pawl arm 470 toward the spool 300.

The first retaining portion 410 and the second retaining portion 420 are protruded inwardly along the radial direction, that is, protruded toward a center of the ring body 480. The engaged teeth 460 are disposed at a distal end of a wall of the communicated hole 450, which is close to the spool 300, and the four stopping portions 441, 442, 443, 444 are protruded toward the center from a proximal end of the wall of the communicated hole 450, which is close to the knob 500, the stopping portions 441, 443 are corresponding to each other, and the stopping portions 442, 444 are corresponding to each other.

Each of the first retaining portion 410 and the second retaining portion 420 has restoring capability in the radial direction, precisely, the first retaining portion 410 has a first free end 411, the second retaining portion 420 has a second free end 421, when each of the first free end 411 and the second free end 421 bears a force applied thereon being larger than the force they can bear, they would be deformed in the radial direction, and when the external force is removed, the first free end 411 and the second free end 421 restore.

The knob 500 includes an engaged portion 540, a protruding cylinder 510, two protrusions 521, 522 (shown in FIG. 2A) and a spiral track 530. The protruding cylinder 510 is protruded toward the locking unit 400, the two protrusions 521, 522 are positioned at the protruding cylinder 510 and are corresponding to each other, the protruding cylinder 510 and the protrusions 521, 522 are protruded into the communicated hole 450 when assembling, such that when the locking unit 400 is at the first position, the protrusion 521 is abutted against the first retaining portion 410, and the second protrusion 522 is abutted against the second retaining portion 420. The spiral track 530 is disposed at an inner wall (not labeled) of the knob 500 for coupling to the guiding portions 430, the engaged portion 540 is also disposed at the inner wall, and has a groove structure corresponding to the mounted portion 250.

Figure 3A:
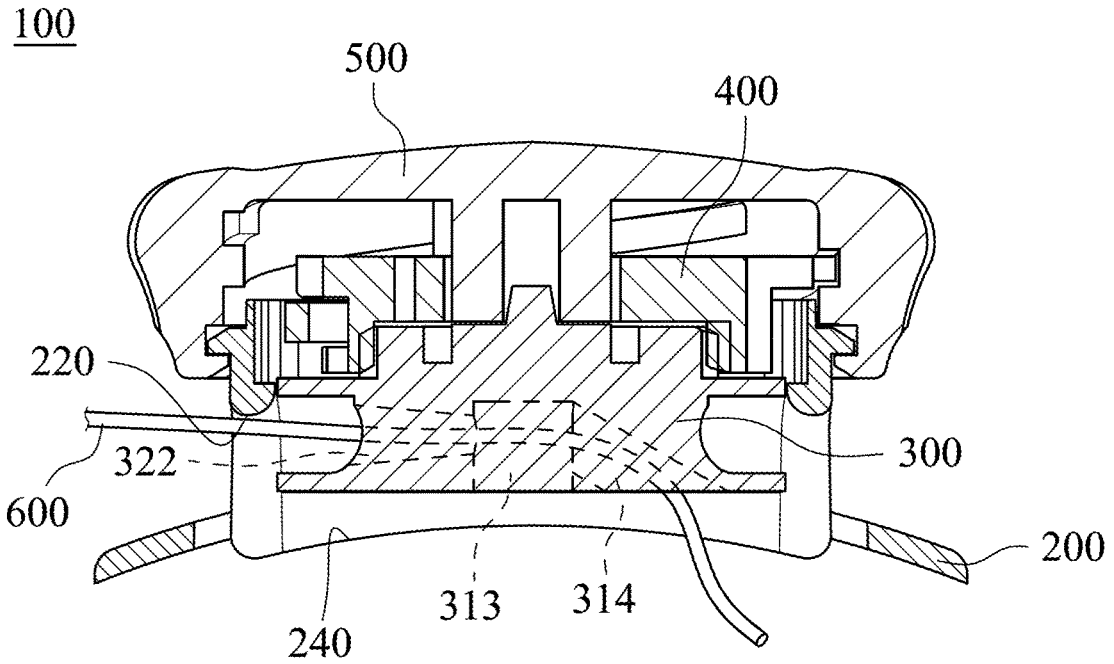
FIGS. 3A to 3C show illustrations of a lace coupling process for the lace of the fastening device of FIG. 1.
Figure 3B:
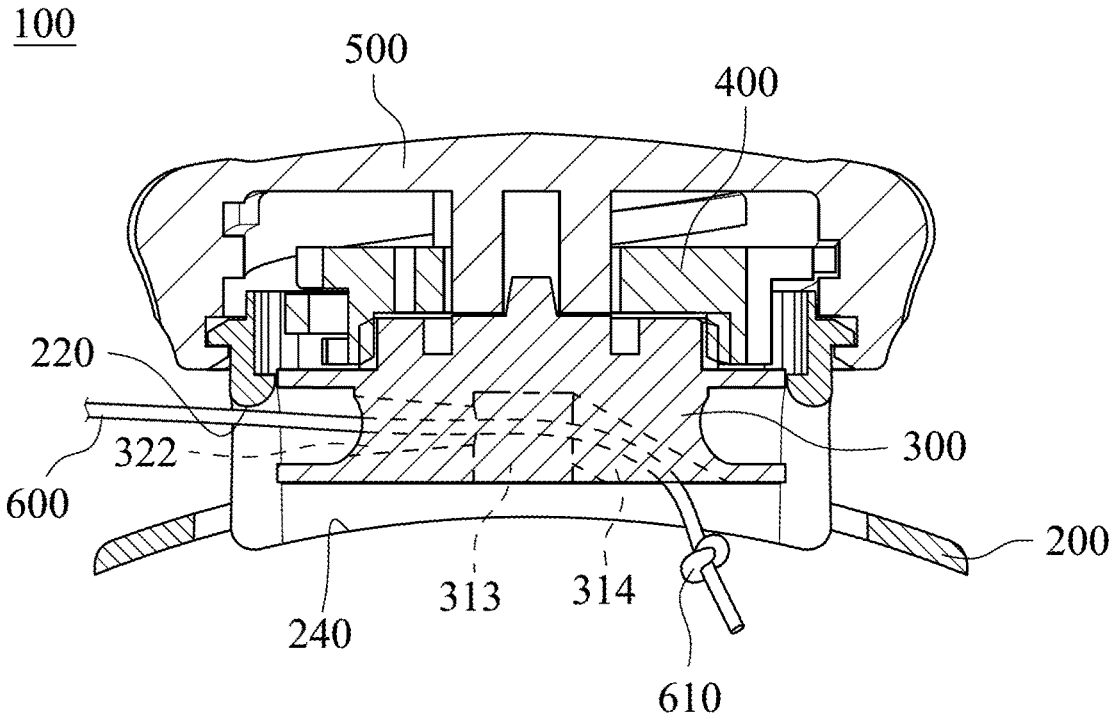
Figure 3C:
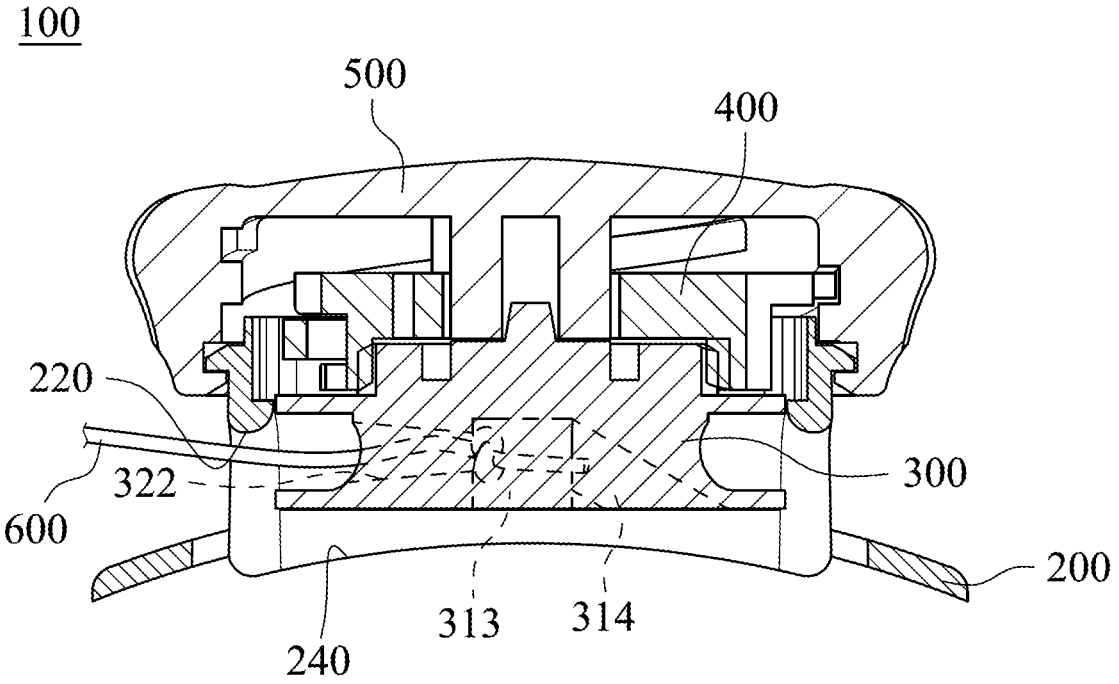

Please refer to FIGS. 3A to 3C, wherein FIGS. 3A to 3C show illustrations of a lace coupling process for the lace 600 of the fastening device 100 of FIG. 1. When assembling the fastening device 100, the spool 300 can be disposed inside the case 200 first, and after the knob 500 is assembled with the locking unit 400, the knob 500 can be covered on the case 200, finally a force can be applied to engage the engaged portion 540 of the knob 500 with the mounted portion 250 of the case 200, such that assembly of the fastening device 100 can be completed.

When the lase 600 is going to be coupled to the spool 300, as shown in FIG. 3A, the second end (not labeled) of the lase 600 can be passed through one of the side holes 220, the second opening 322, the second knotting hole 313 and the second through hole 314, such that the second end is exposed from the lower opening 240. As shown in FIG. 3B, a user (not shown) can tie the second end into a knot 610 and a tail (not labeled), and as shown in FIG. 3C, the lace 600 can be pulled from the second opening 322 by the user, such that the knot 610 can be moved into the second knotting hole 313 so as to be limited in the second knotting hole 313, the tail is left in the second through hole 314, and will not be exposed from the lower opening 240.

Similarly, the first end of the lace 600 (which is opposite to the second end) can be passed through the other one of the side holes 220, the first opening 321, the first knotting hole 311 and the first through hole 312 such that the first end is exposed from the lower opening 240, the user can tie the first end into another knot and another tail (not shown), then the knot can be limited in the first knotting hole 311, and the tail can be left in the first through hole 312.

Figure 4A:
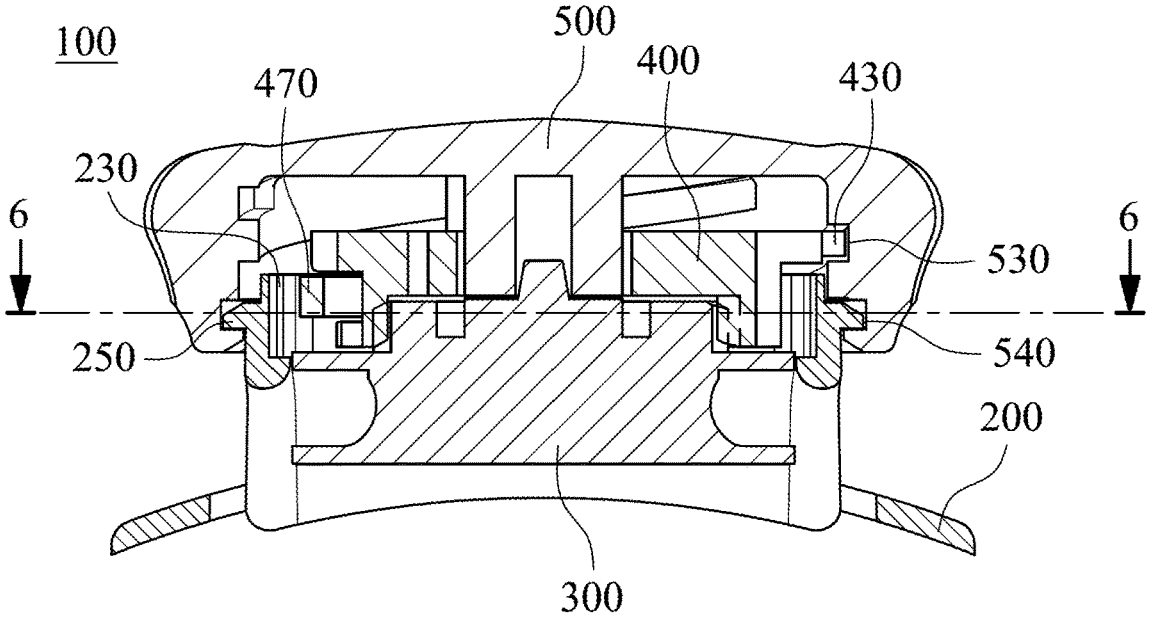
FIG. 4A shows one cross-sectional view of the fastening device of FIG. 1 taken along Line 4-4.
Figure 4B:
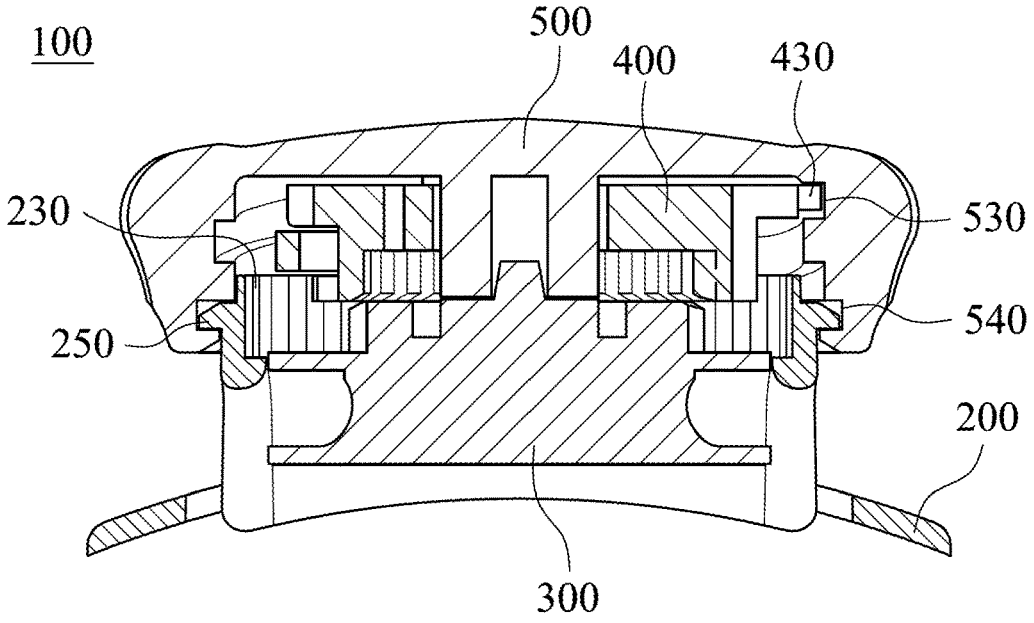
FIG. 4B shows another cross-sectional view of the fastening device of FIG. 1 taken along Line 4-4.

Please refer to FIG. 4A and FIG. 4B, and also refer to FIGS. 2A and 2B together, wherein FIG. 4A shows one cross-sectional view of the fastening device 100 of FIG. 1 taken along Line 4-4, and FIG. 4B shows another cross-sectional view of the fastening device 100 of FIG. 1 taken along Line 4-4.

As shown in FIG. 4A, the guiding portions 430 (shown in FIG. 2B) can be limitedly moved along the spiral track 530 (shown in FIG. 2A), that is, when the knob 500 is rotated relative to the locking unit 400, the guiding portions 430 are moved along the spiral track 530, such that the locking unit 400 is raised or lowered relative to the knob 500. As shown in FIG. 3A, when the locking unit 400 is at the first position, the pawl arms 470 (shown in FIG. 2B) are coordinated with the side teeth 230 (shown in FIG. 2B), and the engaged teeth 460 (shown in FIG. 2A) are engaged with the engaging teeth 330 (shown in FIG. 2B), the pawl arms 470 are disengaged from the side teeth 230 in the tightening direction A2 (shown in FIG. 2B) while engaged with the side teeth 230 in the loosening direction A1 (shown in FIG. 2B) owing to the structure thereof; as a result, when the knob 500 is rotated toward the tightening direction A2 to drive the locking unit 400, the spool 300 linked up therewith can retract the lace 600, when the knob 500 is stopped, the pawl arms 470 are engaged with the side teeth 230 to prohibit the spool 300 from rotating toward the loosening direction A1, and a securing purpose can be achieved.

As shown in FIG. 4B, the locking unit 400 is at the second position when the knob 500 is rotated toward the loosening direction A1 to move the guiding portions 430, since the pawl arms 470 are not engaged with the side teeth 230, the spool 300 can free rotate toward the loosening direction A1, hence, the lace 600 can be pulled out to achieve a releasing purpose. In the embodiment, the engaged teeth 460 are disengaged from the engaging teeth 330 to allow the locking unit 400 to be disengaged from the spool 300 when the locking unit 400 is at the second position, but in other embodiment, the engaged teeth 460 and the engaging teeth 330 can be engaged at the second position, while the pawl arms 470 are disengaged from the side teeth 230, or the pawl arms 470 are engaged with the side teeth 230 at the second position, while the engaged teeth 460 are disengaged from the engaging teeth 330, and will not be limited thereto.

Figure 5A:
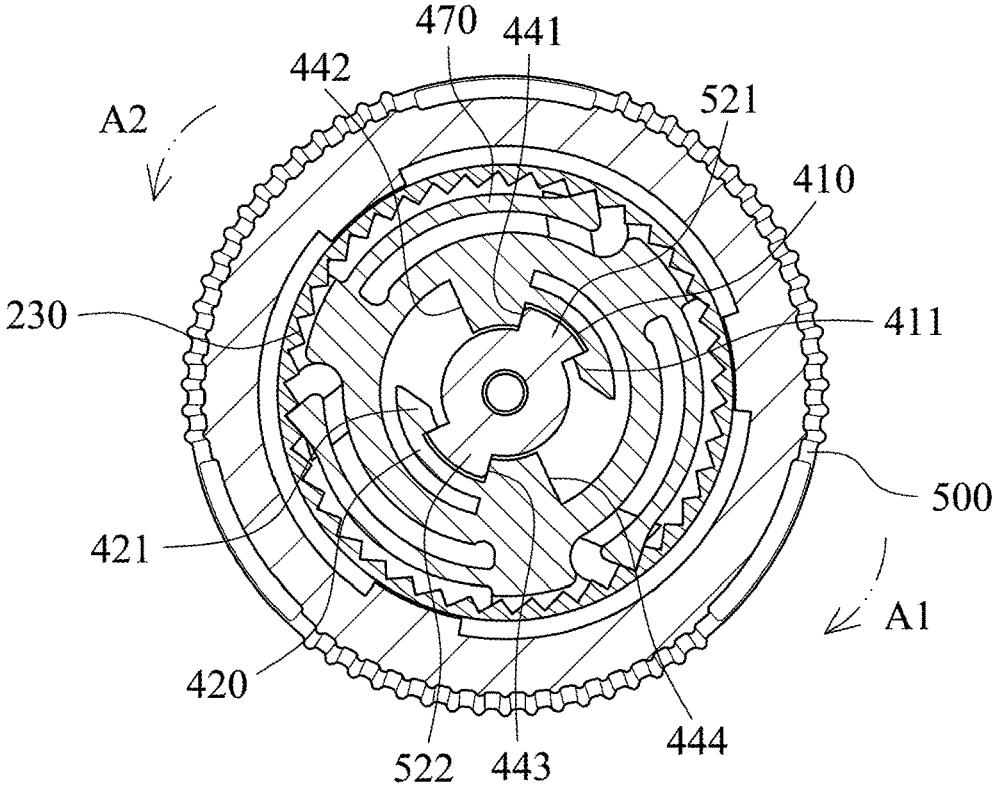
FIG. 5A shows one cross-sectional view of the fastening device of FIG. 1 taken along Line 5-5.
Figure 5B:
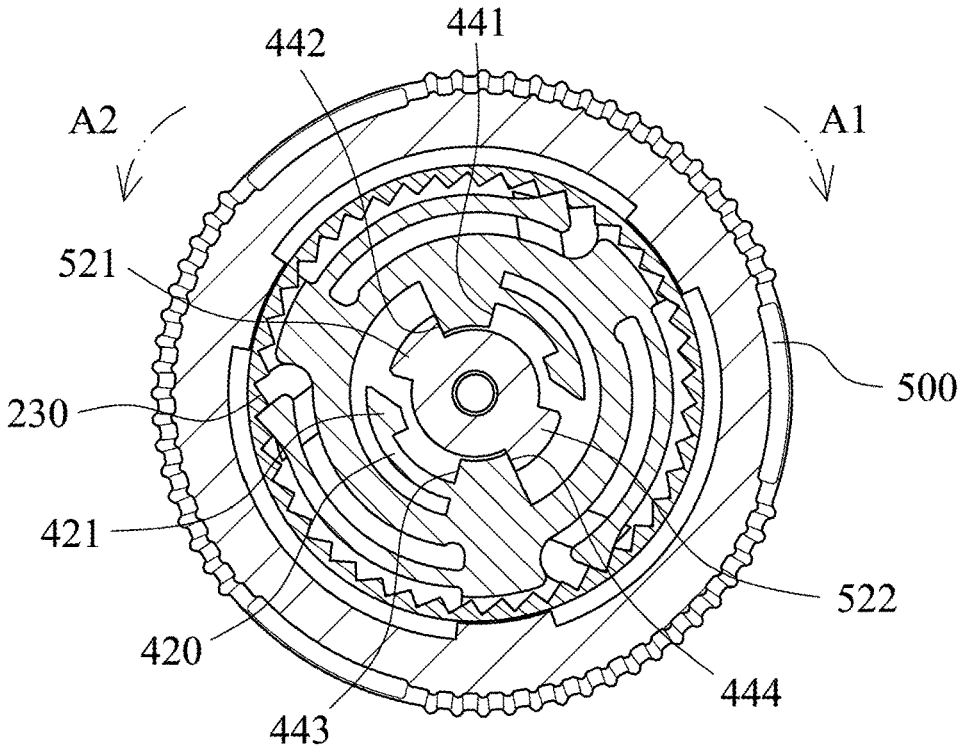
FIG. 5B shows another cross-sectional view of the fastening device of FIG. 1 taken along Line 5-5.

Please refer to FIG. 5A and FIG. 5B, wherein FIG. 5A shows one cross-sectional view of the fastening device 100 of FIG. 1 taken along Line 5-5, and FIG. 5B shows another cross-sectional view of the fastening device 100 of FIG. 1 taken along Line 5-5.

As shown in FIG. 5A, the locking unit 400 is at the first position, the protrusion 521 is abutted against the first retaining portion 410 and the stopping portion 441, the protrusion 522 is abutted against the second retaining portion 420 and the stopping portion 443, thus the knob 500 (shown in FIG. 2A) is engaged with the locking unit 400, and when the knob 500 is rotated toward the tightening direction A2, the protrusion 521 presses the stopping portion 441, the protrusion 522 presses the stopping unit 443, such that the locking unit 400 is driven to rotate. On the other hand, when the knob 500 is stopped, owing to the configuration of the first retaining portion 410 and the second retaining portion 420, the protrusion 521 and the protrusion 522 can be abutted for maintaining the relative position of the knob 500 and the locking unit 400, such that it is favorable for preventing the position of the knob 500 and the engaging unit 400 from being moved by the external force (which is a vibrating force in the environment during using, not the force applied by the user) to lead the lace 600 to be released.

When the knob 500 is rotated toward the loosening direction A1, because of the engagement between the pawl arms 470 and the side teeth 230, the locking unit 400 cannot be rotated, thus the protrusion 521 presses the first free end 411 of the first retaining portion 410 when forced, the protrusion 522 presses the second free end 421 of the second retaining portion 420 when forced, the first free end 411 and the second free end 421 are deformed to move along the radial direction because they can no bear the force, and as shown in FIG. 5B, when the knob 500 is rotated relative to the locking unit 400, the protrusion 521 is abutted against the stopping portion 444 and the protrusion 522 is abutted against the topping portion 442, the first free end 411 and the second free end 421 restore after the force eliminated. Hence, when the knob 500 is rotated relative to the locking unit 400, the guiding portions 430 are moved along the spiral track 530, and the locking unit 400 is driven to change from the first position to the second position.

In addition, if the knob 500 is rotated toward the tightening direction A2 again, the protrusion 521 will touch the first free end 411 first and then press the first free end 411, the protrusion 522 will touch the second free end 421 first and then press the second free end 421, because the locking unit 400 is lowered to a position between the first position and the second position, the pawl arms 470 are engaged with the side teeth 230, and before the pawl arms 470 are disengaged from the side teeth 230 in the tightening direction A2, the pawl arms 470 must be deformed in the radial direction. The first free end 411 and the second free end 421 have to be deformed along the radial direction to allow the locking unit 400 to be switched to the first position in the configuration.

In other embodiment, the structures of the first retaining portion 410 and the second retaining portion 420 can be changed, the retaining portion can couple to the knob, or coupled to the case, only when it has a capability to maintain the relative position of the knob and the locking unit to prohibit the locking unit from being lifted or lowered under a certain force, and the number of the retaining portion and the number of the mounted portion are no limited.

Figure 6A:
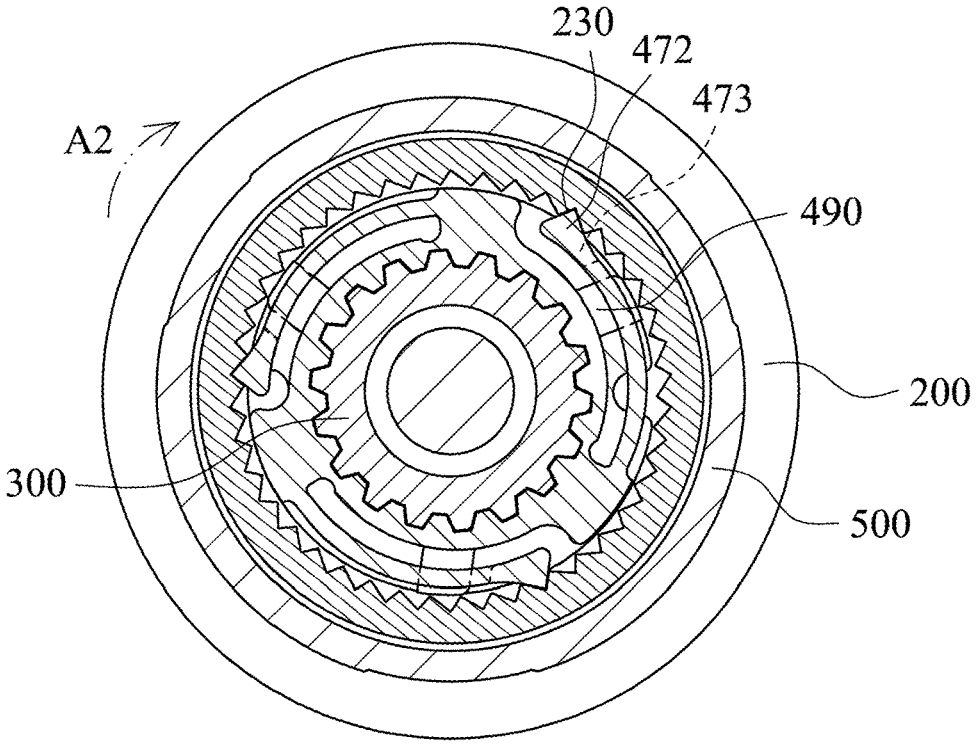
FIG. 6A shows one cross-sectional view of the fastening device of FIG. 4A taken along Line 6-6.
Figure 6B:
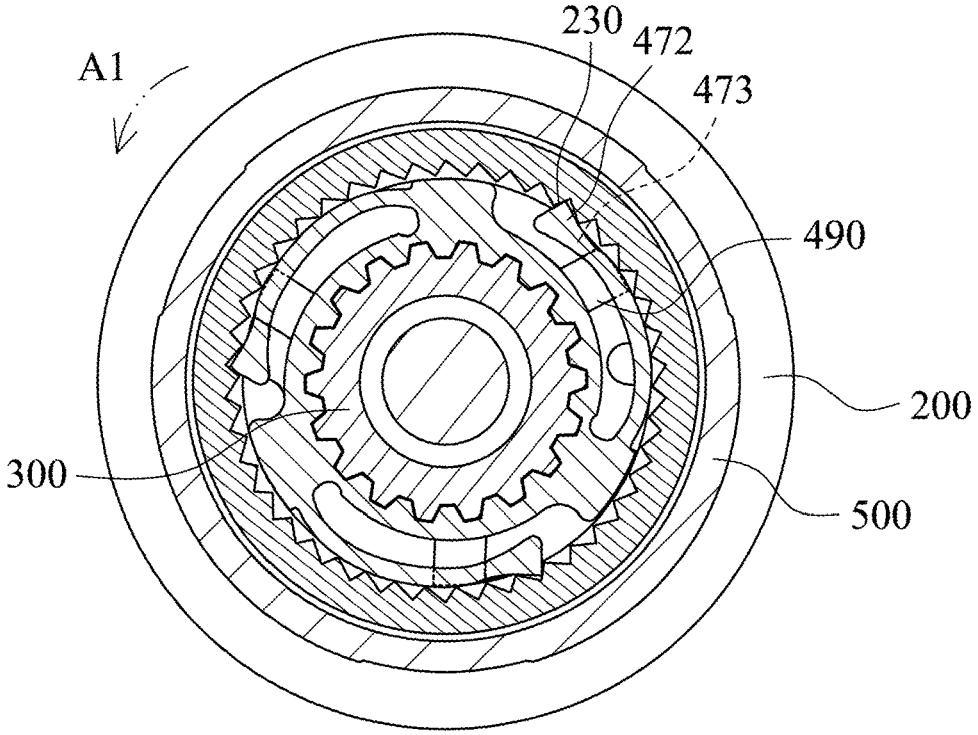
FIG. 6B shows another cross-sectional view of the fastening device of FIG. 4A taken along Line 6-6.

Please refer to FIG. 6A and FIG. 6B, wherein FIG. 6A shows one cross-sectional view of the fastening device 100 of FIG. 4A taken along Line 6-6, FIG. 6B shows another cross-sectional view of the fastening device 100 of FIG. 4A taken along Line 6-6. As shown in FIG. 6A, when the knob 500 is rotated toward the tightening direction A2, the pawl arm 470 will disengage from the side teeth 230, and will not be affected by the blocking portion 490; on the other hand, as shown in FIG. 6B, a tension force in the loosening direction A1 will occur when the lace 600 is tensioned, the pawl arm 470 will engage with the side teeth because of the structure, the abutting portion 473 will abutted against the blocking portion 490 at the same time, such that when the tension force is too large, over bending of the pawl arm 470 can be prevented by the blocking portion 490 and an effect for preventing the pawl arm 470 from breaking can be achieved.

Figure 7:
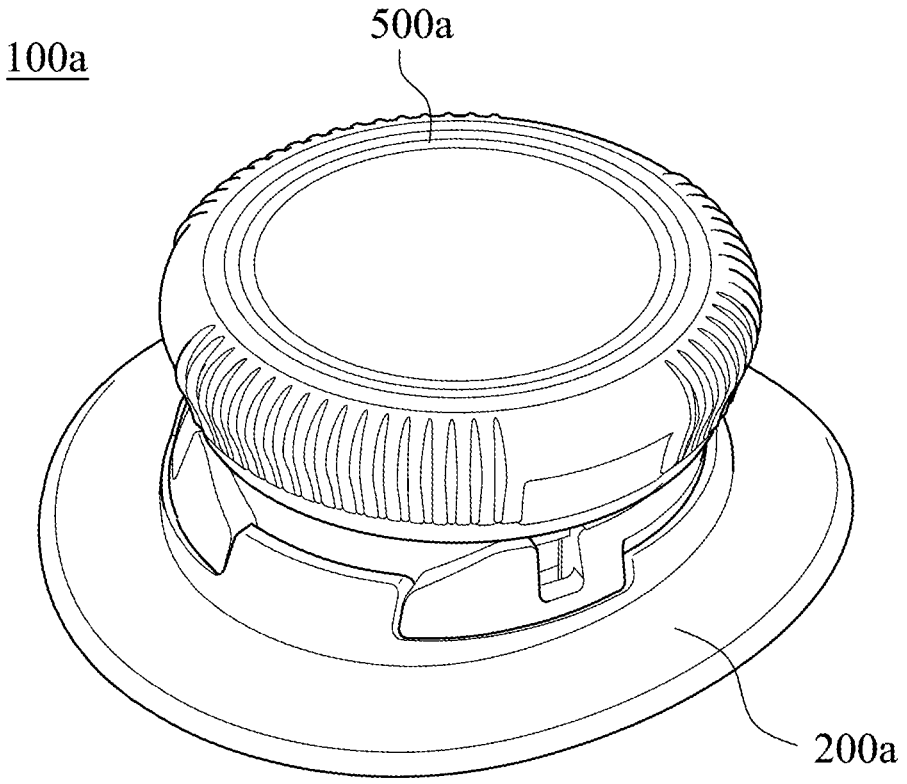
FIG. 7 shows a three dimensional schematic view of a fastening device according to another embodiment of the present disclosure.
Figure 8A:
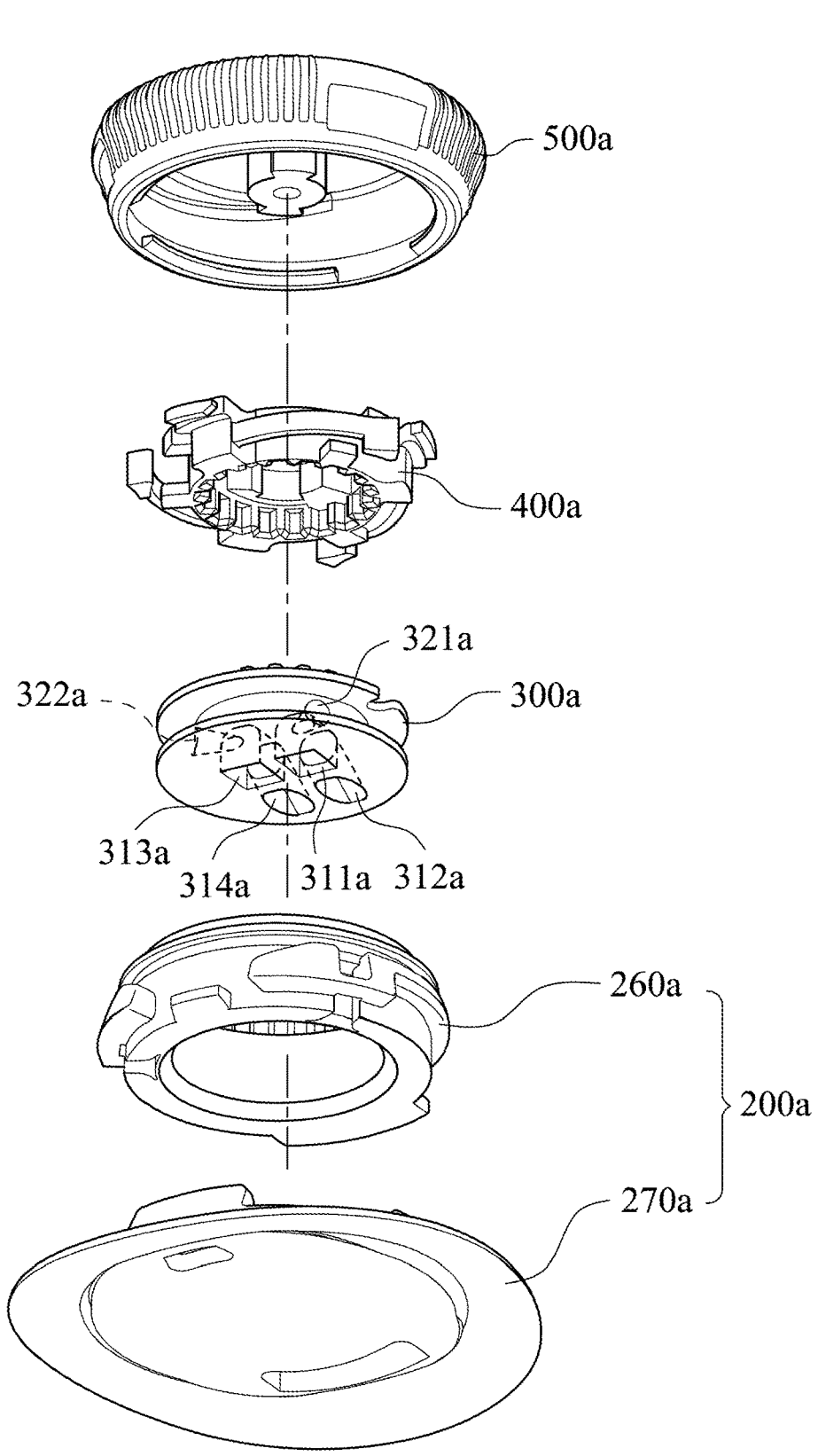
FIG. 8A shows one exploded view of the fastening device of FIG. 7.
Figure 8B:
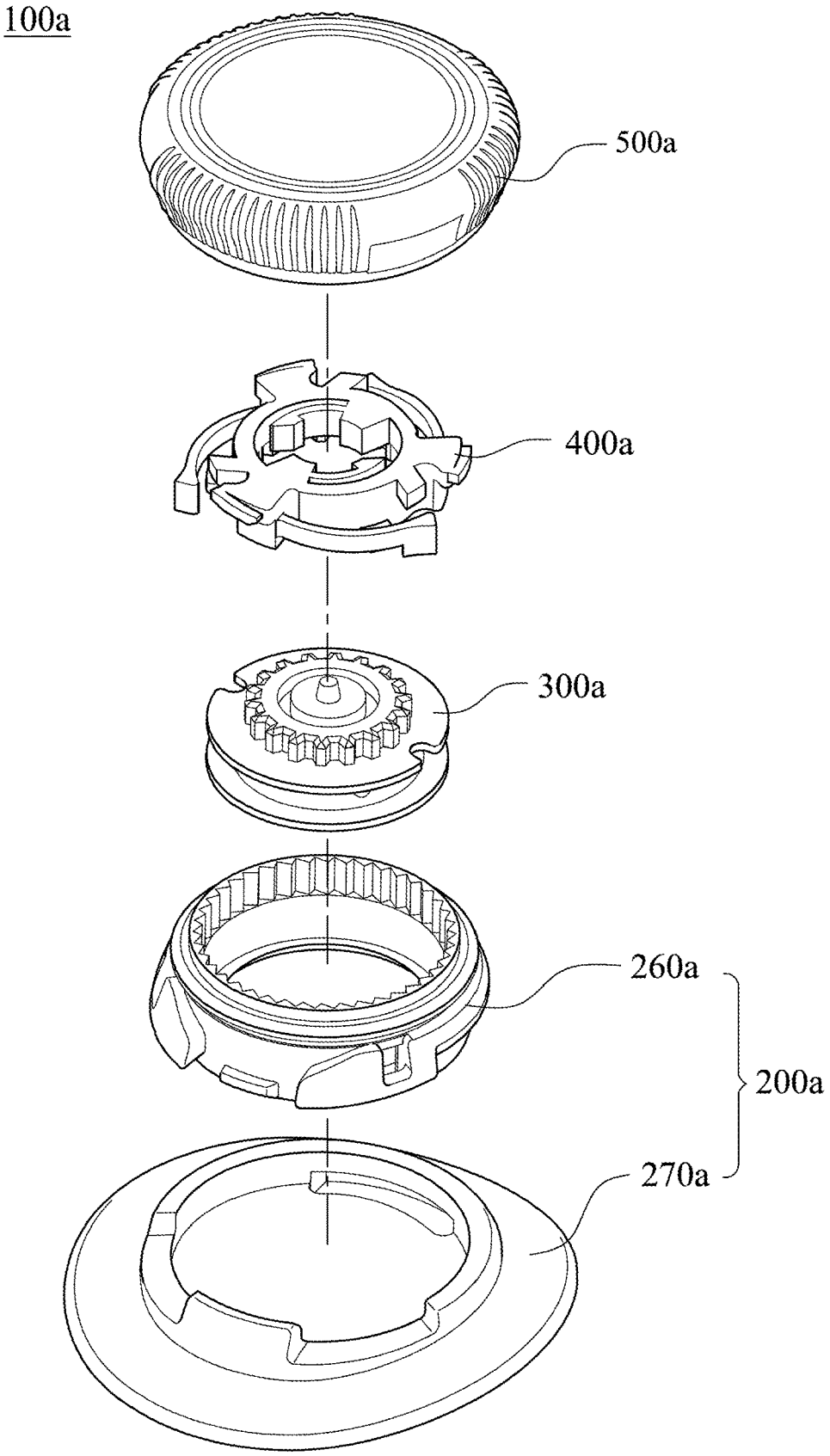
FIG. 8B shows another exploded view of the fastening device of FIG. 7.

Please refer to FIG. 7, FIG. 8A and FIG. 8B, wherein FIG. 7 shows a three dimensional schematic view of a fastening device 100*a* according to another embodiment of the present disclosure, FIG. 8A shows one exploded view of the fastening device 100*a* of FIG. 7, and FIG. 8B shows another exploded view of the fastening device 100*a* of FIG. 7.

The fastening device 100*a* is for loosening and tightening a lace (not shown) and is composed of a case 200*a*, a spool 300*a*, a knob 500*a* and a locking unit 400*a*, the structures and operations of the case 200*a*, the spool 300*a*, the knob 500*a* and the locking unit 400*a* are similar to the structures of the case 200, the spool 300, the knob 500 and the locking unit 400 of FIGS. 1 to 5B, but the difference is, the relationships between the first opening 321*a*, the second opening 322*a*, the first knotting hole 311*a*, the first though hole 312*a*, the second knotting hole 313*a* and the second through hole 314*a* of the spool 300*a* being different from the relationships between the first opening 321, the second opening 322, the first knotting hole 311, the first though hole 312, the second knotting hole 313 and the second through hole 314. Precisely, the lace of the embodiment is coupled to the spool 300*a* with an angle of 60 degrees, and the lace of the embodiment of FIG. 1 is couple to the spool 300 with an angle of 180 degrees.

Additionally, in the embodiment, the case 200*a* can further include a base 270*a* in addition to the housing 260*a*, after coupling the lace to the spool 300*a* as shown in FIGS. 3A to 3C, the base 270*a* can coupled to the housing 260*a*, serving as a protection function.

Through the abovementioned embodiment, the present disclosure has advantages as follows.

1. Through the structure configuration of the blocking portion and the pawl arm, broken of the pawl arm due to over loading can be prevented, in addition to increasing the securing capability, the lifetime of the fastening device can be increased.

2. Through the structure configuration of the lower opening and the spool, the lace can be coupled to the spool after the fastening device is assembled, the manufacturing process is simplified, and the user can couple the lace to the fastening device after threading the lace through the holes of the articles, such that the using convenience is increased.

3. Through the configuration of the guiding portion and the spiral track, the locking unit can change position when the knob is rotated; thus the tension state or loose state can be changed.

4. Through the configuration of the first retaining portion and the second retaining portion, the relative position of the knob and the locking unit at the first position or the second position can be maintained, and loose of the lace owing to the environment force can be prevented.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A fastening device, which is for fastening and loosening a lace, the fastening device comprising:

a case, comprising a receiving space and a plurality of side teeth;

a spool disposed within the case, wherein the lace is wound therearound;

a locking unit, comprising:

a ring body selectively coupled to the spool and comprising a blocking portion; and at least one pawl arm, comprising:

a first terminal connected to the ring body; and a second terminal opposite to the first terminal, wherein the second terminal is engaged with the side teeth in a loosening direction and is disengaged from the side teeth in a tightening direction opposite to the loosening direction, and the second terminal comprises:

an abutting portion abutted against the blocking portion in the loosening direction; and a knob coupled to the locking unit;

wherein rotating the knob relative to the case allows the locking unit to be driven to switch from a first position to a second position, the locking unit is coupled to the spool to prohibit the spool from rotating toward the loosening direction when the locking unit is at the first position, and the spool is allowed to be rotated toward the loosening direction when the locking unit is at the second position.

2. The fastening device of claim 1, wherein the ring body has a radial direction, and the blocking portion is protruded outwardly from the ring body along the radial direction.

3. The fastening device of claim 2, wherein the locking unit further comprises:

a first retaining portion and a second retaining portion disposed at the ring body and coupled to the knob, each of the first retaining portion and the second retaining portion has restoring capability in the radial direction.

4. The fastening device of claim 3, wherein the knob comprises two protrusions coupled to the first retaining portion and the second retaining portion, respectively, and when the locking unit is driven by the knob to switch from the first position to the second position, the two protrusions push the first retaining portion and the second retaining portion, respectively, to move along the radial direction.

5. The fastening device of claim 1, wherein the knob comprises a spiral track, and the locking unit comprises:

a guiding portion coupled to the spiral track;

wherein when the knob is rotated toward the loosening direction, the guiding portion guided by the spiral track is raised such that the locking unit is switched to the second position.

6. A fastening device, which is for fastening and loosening a lace, the fastening device comprising:

a case, comprising a receiving space and a plurality of side teeth;

a spool disposed within the case, wherein the lace is wound therearound;

a locking unit comprising a blocking portion and at least one pawl arm, wherein the at least one pawl arm is engaged with the side teeth and abutted against the blocking portion in a loosening direction, and the at least one pawl arm is disengaged from the side teeth in a tightening direction opposite to the loosening direction; and a knob coupled to the locking unit;

wherein rotating the knob relative to the case allows the locking unit to be driven to switch from a first position to a second position, the locking unit is coupled to the spool to prohibit the spool from rotating toward the loosening direction when the locking unit is at the first position, and the spool is allowed to be rotated toward the loosening direction when the locking unit is at the second position.

7. The fastening device of claim 6, wherein the locking unit comprises a ring body, the ring body has a radial direction, the blocking portion is protruded outwardly from the ring body along the radial direction, and the ring body, the blocking portion and the at least one pawl arm are integrally formed.

8. The fastening device of claim 7, wherein the locking unit further comprises:

a first retaining portion and a second retaining portion disposed at the ring body and coupled to the knob, each of the first retaining portion and the second retaining portion has restoring capability in the radial direction.

9. The fastening device of claim 8, wherein the knob comprise two protrusions coupled to the first retaining portion and the second retaining portion, respectively, when the locking unit is driven by the knob to switch from the first position to the second position, the two protrusions push the first retaining portion and the second retaining portion, respectively, to move along the radial direction.

10. The fastening device of claim 6, wherein the knob comprises a spiral track, and the locking unit comprises:

a guiding portion coupled to the spiral track;

wherein when the knob is rotated toward the loosening direction, the guiding portion guided by the spiral track is raised such that the locking unit is switched to the second position.

* * * * *